US005965504A

United States Patent [19]

Reynolds

[11] Patent Number: 5,965,504

[45] Date of Patent: Oct. 12, 1999

[54] DRY-CLEANING ARTICLE, COMPOSITION AND METHODS

[76] Inventor: Rayvon E. Reynolds, 5563 Wydella Rd., Lilburn, Ga. 30047

[21] Appl. No.: 09/170,755

[22] Filed: Oct. 13, 1998

[51] Int. Cl.[6] ..... D06L 1/02

[52] U.S. Cl. ..... 510/285; 8/142; 8/137; 510/291; 510/277; 510/295

[58] Field of Search ..... 8/142, 137; 510/285, 510/291, 277, 295

[56] References Cited

U.S. PATENT DOCUMENTS

| | | | |
|---|---|---|---|
| 3,261,185 | 7/1966 | Rihr . | |
| 3,432,253 | 3/1969 | Dixon et al. . | |
| 3,593,544 | 7/1971 | Henderson . | |
| 3,776,853 | 12/1973 | Minter . | |
| 3,827,857 | 8/1974 | Boulus . | |
| 3,907,496 | 9/1975 | Neel et al. . | |
| 3,920,389 | 11/1975 | Eanzel . | |
| 3,933,425 | 1/1976 | Grunewalder et al. . | |
| 4,077,878 | 3/1978 | Jackson . | |
| 4,176,080 | 11/1979 | Wise et al. . | |
| 4,234,627 | 11/1980 | Schilling . | |
| 4,336,024 | 6/1982 | Denissenko et al. | 8/142 |
| 4,790,856 | 12/1988 | Wixon . | |
| 5,082,466 | 1/1992 | Rubenstein et al. . | |
| 5,196,132 | 3/1993 | Mains et al. . | |
| 5,238,587 | 8/1993 | Smith et al. . | |
| 5,442,938 | 8/1995 | Kislyuk . | |
| 5,504,954 | 4/1996 | Joo et al. . | |
| 5,547,476 | 8/1996 | Siklosi et al. . | |
| 5,591,236 | 1/1997 | Roetker | 8/137 |
| 5,630,847 | 5/1997 | Roetker | 8/137 |
| 5,630,848 | 5/1997 | Young et al. | 8/137 |
| 5,632,780 | 5/1997 | Siklosi | 8/137 |
| 5,687,591 | 11/1997 | Siklosi et al. | 8/159 |
| 5,746,776 | 5/1998 | Smith et al. | 8/142 |
| 5,858,022 | 1/1999 | Romack et al. | 8/142 |

FOREIGN PATENT DOCUMENTS

| | | |
|---|---|---|
| WO 96/30583 | 10/1996 | European Pat. Off. . |
| WO 97/00738 | 1/1997 | European Pat. Off. . |

*Primary Examiner*—Yogendra Gupta
*Assistant Examiner*—Brian P. Mruk
*Attorney, Agent, or Firm*—Law Office of Jon M. Jurgovan

[57] ABSTRACT

The invention is directed to a dry-cleaning article suitable for use in the home. The article includes a sheet that is permeated with 51–98% by weight of organic solvent such as paraffins, olefins, acetylenes or mixtures thereof, 1–35% by weight of water, optionally with 1–14% by weight of emulsifier such as PEMULEN™, Carbopol™, Emuluin™ and/or Emulphor™ to allow the water to be uniformly mixed into the solvent. The composition can also include 1–5% by weight of perfume for scenting clothing, and 1–5 % by weight of nonionic and/or anionic surfactant to provide additional stain removal capability of the composition. The invented composition is thus organic-solvent-based and is particularly effective to remove body or cosmetic oil stains from garments. The invention is also directed to the composition and methods for using the sheet in a drying machine.

17 Claims, No Drawings

DRY-CLEANING ARTICLE, COMPOSITION AND METHODS

BACKGROUND OF THE INVENTION

1. Field of the Invention

This invention is directed to a dry-cleaning composition, article and methods that can be used for garment freshening and cleaning.

2. Description of the Related Art

U.S. Pat. No. 5,547,476 (hereinafter referred to as "the '476 patent") issued Aug. 20, 1996 to Siklosi et al. discloses a home dry-cleaning process. In the process of the '476 patent, a carrier sheet is releasably impregnated with a cleaning composition. The sheet and clothing to be cleaned are sealed in an air-tight bag that is placed in a dryer. As the dryer's drum heats and rotates, the sheet releases the cleaning composition to clean the clothes contained in the bag. The cleaning composition disclosed in the '476 patent includes water, etherfied propanol solvent, 1,2-octanediol, and an emulsifier. The specific requirement to use etherfied propanol solvent is disadvantageous in that there are many types of common garment stains that cannot be cleaned effectively with this substance. In addition, etherfied propanol can remove colors, particularly in garments made of silk. In addition, 1,2-octanediol is not a widely available substance, and the requirement that it be used in the composition of the '476 patent increases the cost of the composition. In addition, all embodiments of the '476 patent disclose water-based compositions in which water constitutes the largest constituent. Although such water-based compositions are effective in removing some types of garment stains, commonly occurring stains such as body or cosmetic oils are not effectively removed with water-based cleaning compositions, and such large amounts of water can remove color from garments.

U.S. Pat. No. 5,238,587 (hereinafter referred to as "the '587 patent") discloses a composite fabric-cleaning article including a flexible porous base sheet with a coating of a gelled cleaning composition. In a manner similar to the '476 patent, the sheet is placed in an air-tight bag with clothing, which is sealed and placed in a dryer. The composition includes about 60–90% water, about 0.25–5% gelling agent, about 2–32% of a water miscible organic solvent and about 5–10% surfactant. Thus, like the composition of the '476 patent, the composition of the '587 patent is water-based and accordingly relatively ineffective in cleaning garment stains caused by body or cosmetic oils, and such large amounts of water can remove color from some garments. It would be desirable to provide a dry-cleaning kit suitable for use in the home, that is effective in cleaning the oil-based garment stains for which dry-cleaning is most often required.

SUMMARY OF THE INVENTION

This invention overcomes the above-noted disadvantages. The dry-cleaning article of this invention includes a sheet that is permeated with an organic solvent and water, and optionally other substances, in which organic solvent is the largest constituent by weight of all substances permeated in the sheet. In one embodiment, the sheet is permeated with 51–98% by weight of organic solvent, and 1–35% by weight of water. As used herein, the weight percentages of the substances reflect the range of proportions of the substances relative to all substances permeated in the sheet. Optionally, the organic solvent and water can also be mixed into a composition with 1–14% by weight of emulsifier to allow the water to be uniformly mixed into the solvent before permeation into the sheet. The sheet can also be permeated with 1–5% by weight of a perfume substance for scenting clothing and/or 1–5% by weight of nonionic and/or anionic surfactant substance to provide additional stain removal capability. The substances permeated into the invented article are thus organic-solvent-based and as such is particularly effective in removing body or cosmetic oil stains from garments. The above-stated substances can be permeated separately into the same or different areas of the sheet, or mixed together into a uniform composition and then permeated into the sheet. However, permeating the substances into the sheet without prior mixing eliminates the need for emulsifier which can be omitted to reduce costs without adverse impact on the effectiveness of the invented dry-cleaning article.

In one preferred method for using the dry-cleaning sheet, the sheet is placed within a dryer along with clothing to be dry-cleaned and is allowed to tumble with the clothing at 40–90° Celsius for five to thirty minutes. The organic solvent and water in the sheet act upon the clothing and remove oil-based stains during tumbling in the dryer.

A second preferred method of the invention is particularly useful if the clothing to be dry-cleaned has delicate buttons or trim. The clothing is placed in a container such as a perforated bag along with a sheet permeated with organic solvent, water and optionally the other substances as stated above, and is tumbled in a dryer under the same range of temperatures and time durations as stated above with respect to the first method. After tumbling in the dryer, the clothing is removed from the bag and is ready to be worn.

These together with other features and advantages, which will become subsequently apparent, reside in the details of construction and operation as more fully hereinafter described and claimed.

DESCRIPTION OF THE PREFERRED EMBODIMENTS

In one embodiment of the present invention, a dry-cleaning sheet is permeated with substances which can be included in a composition with 51–98% by weight of organic solvent. The organic solvent can include paraffins, olefins, acetylenes and mixtures thereof. A preferred organic solvent is "QED2" commercially available from Sentry Chemical, Inc. of Atlanta, Ga., although other specific types of organic solvent are suitable for use in the invention. QED2 is particularly advantageous for use in the invention, however, because it is safe for home use, i.e., it has relatively low toxicity, in contrast to other types of chemicals such as perchloroethylene ("perc") which is widely used in the dry-cleaning industry but which is toxic and therefore requires commercial equipment for containment.

The preferred dry-cleaning composition also includes 1–35% by weight of water. Preferably, however, the dry-cleaning composition includes water in a quantity less than 25% by weight so that the water will readily stabilize when mixed with the other substances included in the invented composition. The water in the composition serves several purposes. For one, water is of course effective in the removal of water-soluble stains from clothing, so its inclusion in the invented composition in limited amounts that will not remove significant color from garments is beneficial for this reason. Also, water is an effective agent in removing wrinkles from articles of clothing or other fabric items. Another factor which makes the inclusion of water beneficial in the invented composition is that organic solvents such as QED2 ordinarily will ignite at relatively low temperatures, i.e., they generally have relatively low flash-points. For example, QED2 ignites at approximately 110° Celsius. The inclusion of water with the organic solvent in the invented composition is thus useful in raising the flash-point of the composition so that it is much less likely to be accidentally ignited.

Because the organic solvent and water substances are generally immiscible, the invented composition can include 1–14% by weight of emulsifier substance to allow the water to be uniformly mixed into the solvent. The preferred mixture is 4% by weight of nonionic emulsifier and 1% by weight of anionic emulsifier. The nonionic and anionic emulsifiers that can be used in the invented composition are numerous and widely available commercially. Examples of anionic emulsifiers include substances commercially available under the trademarks PEMULEN™, Carbopol™, and examples of nonionic emulsifiers include substances commercially available under the trademarks EMULIUN™ and Emulphor™. Such emulsifiers are commercially available from a large number of sources, including Sentry Chemical Co. of Atlanta, Ga.

The composition can also include 1–5% by weight of a perfume substance for scenting clothing. Such perfume can include numerous scents which are commercially available from a large number of sources, including Ungurer, Inc. of Lincoln Park, N.J.

In addition, for enhanced stain removal capability, the invented composition can include 1–5% by weight of surfactant substance, preferably nonionic or anionic, such as nonyl phenoxy polyethoxy ethanol commercially available from Sentry Chemical of Atlanta, Ga.

The invented composition is preferably made by mixing appropriate amounts the emulsifier with the water in a containment vessel using a glass rod or the like. The resulting mixture is poured into the organic solvent in another containment vessel while stirring until a stable emulsion forms. Generally, water is preferred to be used in the composition in a quantity that is less than 25% by weight so that the mixture forms a stable emulsion upon mixing the solvent, water and emulsifier together. If used, the perfume and surfactant can be mixed into the emulsion to finish the formulation of the invented composition.

The article of this invention includes a sheet that is permeated with the invented composition. Alternatively, the same or different portions of the sheet can be permeated with organic solvent and water, and optionally also perfume and surfactant. The organic solvent constitutes 51–98% by weight of all substances permeated in the sheet, and water constitutes 1–35% by weight of the substances permeated in the sheet. The sheet can also be permeated with perfume which constitutes 1–5% by weight of all substances permeated in the sheet, and surfactant which constitutes 1–5% by weight of all substances permeated in the sheet. The sheet is preferably a low-cost pliable material that is absorbent to allow the above-stated substances to be permeated therein, and that is also not prone to deterioration in a dryer. Such sheet can be a non-woven fabric, paper towel, fibrous batting or the like made from cotton, rayon, polyester fibers or wood pulp. Preferably, the sheet material is square or rectangular in shape and is from ten to four-hundred square centimeters in size. The total volume of the substances permeated in the sheet are preferred to be about twenty (20) cubic centimeters or less.

In a mass production context, the invented composition is poured from one or more perforated conduits onto a continuous sheet moving on a conveyor, for example, down a production line. The composition can be spread with a doctor's blade, a rod or the like which is positioned closely to the sheet material downstream of the conduit with respect to the direction of movement of the sheet material in the production line. The composition is thus spread out so that it permeates the sheet uniformly. Alternatively, the composition can be provided to the conduit under pressure and sprayed through its perforations onto the sheet material as it advances along the conveyor. If the organic solvent and water are not mixed into a composition with an emulsifier, separate conduits and/or spray nozzles can be provided for the organic solvent, water and optionally also perfume and/or surfactant, and used to apply these substances to the same or different portions of the sheet. The elongated sheet then can be cut with a knife or die cutter into sections that are preferably wrapped in individual foil packets and packaged into boxes or other containers for sale to consumers for use in home drying machines.

In the first preferred method, a sheet (preferably just after removal from its foil packet) is placed in a home dryer along with the clothing that is to be dry-cleaned. The clothing is then tumbled with the sheet for 5 to 45 minutes in air heated to a temperature of 40°–90° Celsius. Preferably, the clothing is tumbled with the sheet for at least 15 minutes at an air temperature over 50° Celsius. Due to the action of the substances released from the sheet by the heat of the dryer as well as the contact of the sheet with the clothing during tumbling, the clothing is cleaned of oil-based stains such as body or cosmetic oils as well as water-soluble materials. After tumbling, the clothing can be removed from the drying machine and worn.

In the second preferred method, the sheet is placed within a container such as an air-permeable bag, along with the clothing that is to be cleaned. The container is then closed and placed inside of the drying machine. The container is tumbled inside of the drying machine under similar air temperature conditions and time durations as stated above with respect to the first invented method, to clean the clothing in the container. After tumbling in the drying machine, the container is removed from the machine and the container is opened to extract the clothing that is ready to be worn. Preferably, the container is a bag made of nylon material that can withstand the elevated temperatures in the drying machine. Also, the bag is preferred to be perforated so that air flows easily through the bag to avoid wrinkling of the clothing therein. The perforations or openings for air flow in the bag are preferred to be much less than the size of buttons or trim on the clothing to be cleaned so that such clothing features do not extend through the openings in the bag and are thus protected from damage by the bag as the clothing tumbles in the dryer. Also, so that clothing can be readily placed into or taken out of the bag, the bag preferably defines an opening that can be closed with a drawstring or the like. The bag may be used repeatedly or may be disposable.

The many features and advantages of the present invention are apparent from the detailed specification and thus, it is intended by the appended claims to cover all such features and advantages of the described composition, article and methods which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

I claim:

1. An article for dry-cleaning clothing in a home drying machine, the article comprising:

a sheet permeated with substances including at least one organic solvent selected from the group consisting of paraffin, olefin, acetylene or mixtures thereof, water, and at least one emulsifier to permit the organic solvent and water to stabilize together, the organic solvent constituting 51–98% by weight of the substances permeated in the sheet, the water constituting less than 25% by weight of the substances permeated in the sheet.

2. An article as claimed in claim 1, wherein the organic solvent and water are mixed in a composition that includes 1–14% by weight of the emulsifier to allow the organic solvent and water to be mixed together, the composition being permeated into the sheet.

3. An article as claimed in claim 1, wherein the sheet is further permeated with a perfume substance.

4. An article as claimed in claim 3, wherein the perfume constitutes 1–5% by weight of the substances permeated in the sheet.

5. An article as claimed in claim 1, wherein the sheet is pliable.

6. An article as claimed in claim 1, wherein the sheet is composed of a material that is absorbent to the substances.

7. An article as claimed in claim 1, wherein the sheet includes at least one of a non-woven fabric, paper towel or fibrous batting.

8. An article as claimed in claim 1, wherein the sheet is further permeated with a surfactant substance.

9. An article as claimed in claim 8, wherein the surfactant comprises 1–5% by weight of the substances permeated in the sheet.

10. An article as claimed in claim 9, wherein the surfactant includes nonyl phenoxy polyethoxy ethanol.

11. An article as claimed in claim 1, further comprising:

a foil wrapping to seal the sheet permeated with the composition for storage until required for use.

12. An article as claimed in claim 11, further comprising a box to contain the sheet and its foil wrapping.

13. A method comprising the step of:

a) permeating a sheet for use in a home drying machine with substances including organic solvent selected from the group consisting of paraffin, olefin, acetylene or mixtures thereof, water, and at least one emulsifier to permit the organic solvent and water to stabilize together, the organic solvent constituting 51–98% by weight of the substances permeated in the sheet, the water constituting less tan 25% by weight of the substances permeated in the sheet.

14. A method as claimed in claim 13, wherein a perfume substance is permeated in the sheet in said step (a), the perfume constituting 1–5% by weight of the substances permeated into the sheet.

15. A method as claimed in claim 13, further comprising the step of:

b) mixing the organic solvent and water with an emulsifier substance to form a stable composition used to permeate the sheet material in said step (a), the emulsifier constituting 1–14% by weight of the substances permeated in the sheet.

16. A method as claimed in claim 13, wherein the sheet material includes at least one of a non-woven fabric, paper towel and fibrous batting.

17. An article for dry-cleaning clothing in a home drying machine, the article comprising:

a sheet permeated with substances including:

about 61–98% organic solvent by weight of the substances permeated in the sheet, the organic solvent selected from the group consisting of paraffin, olefin, acetylene or mixtures thereof;

from 1% to less than 25% water by weight of the substances permeated in the sheet; and 1–14% emulsifier by weight of the substances permeated in the sheet.

* * * * *